US007868601B1

(12) United States Patent
Li

(10) Patent No.: US 7,868,601 B1
(45) Date of Patent: Jan. 11, 2011

(54) SYSTEM AND METHOD FOR CONTROLLING A REGULATOR CIRCUIT FOR RADIO FREQUENCY POWER AMPLIFIER BIASES

(75) Inventor: Yushan Li, Longmont, CO (US)

(73) Assignee: National Semiconductor Corporation, Santa Clara, CA (US)

( * ) Notice: Subject to any disclaimer, the term of this patent is extended or adjusted under 35 U.S.C. 154(b) by 696 days.

(21) Appl. No.: 11/818,752

(22) Filed: Jun. 15, 2007

(51) Int. Cl.
*G05F 1/00* (2006.01)

(52) U.S. Cl. ..... 323/283; 323/322

(58) Field of Classification Search ..... 323/271, 323/265, 266, 267, 269, 270, 273, 283, 322
See application file for complete search history.

(56) References Cited

U.S. PATENT DOCUMENTS 6,031,362 A 2/2000 Bradley
6,130,525 A 10/2000 Jung et al.
6,148,220 A 11/2000 Sharp et al.
6,624,702 B1 9/2003 Dening
6,624,711 B1 9/2003 Khan et al.
6,624,712 B1 9/2003 Cygan et al.
6,636,112 B1 10/2003 McCune
6,701,138 B2 3/2004 Epperson et al.
6,757,526 B1 6/2004 Sharp et al.
6,822,511 B1 11/2004 Doherty et al.
6,822,523 B2 11/2004 Grosspietsch et al.
6,844,776 B2 1/2005 Schell et al.
6,850,044 B2 2/2005 Hansen et al.
6,897,730 B2 5/2005 Dupuis et al.
6,900,697 B1 5/2005 Doyle et al.
6,914,487 B1 7/2005 Doyle et al.
6,975,494 B2 12/2005 Tang et al.
7,024,649 B2 4/2006 Collmeyer et al.
7,038,536 B2 5/2006 Cioffi et al.
7,058,373 B2 6/2006 Grigore
7,071,668 B2 7/2006 Sasaki
7,102,338 B2 9/2006 Osburn et al.
7,132,891 B1 11/2006 Dening et al.
7,256,571 B1 * 8/2007 Mimberg et al. ..... 323/267
7,342,387 B1 3/2008 Li
7,378,823 B2 * 5/2008 Yamanaka et al. ..... 323/267
7,382,195 B2 6/2008 Chen et al.
7,471,155 B1 12/2008 Levesque
7,679,433 B1 3/2010 Li (Continued)

OTHER PUBLICATIONS

Imtiaz Ali et al., "A Fast Response, Programmable PA Regulator Subsystem for Dual Mode CDMA/AMPS Handsets," 2000 IEEE, pp. 139-142.

(Continued)

*Primary Examiner*—Bao Q Vu
*Assistant Examiner*—Nguyen Tran

(57) ABSTRACT

A system and method are disclosed for controlling a regulator circuit that outputs a plurality of radio frequency power amplifier bias voltages. A feedback loop is connected to the regulator circuit from the plurality of bias voltages that are output from the regulator circuit. The feedback loop comprises a demultiplexer circuit and a multiplexer circuit that are connected to the regulator circuit. The demultiplexer circuit and the multiplexer circuit each receive an enable signal and provide a feedback signal to the regulator circuit from the bias voltage that is associated with the received enable signal. The invention allows the regulator circuit to be configured as needed to provide different values of radio frequency power amplifier bias voltages.

21 Claims, 4 Drawing Sheets

U.S. PATENT DOCUMENTS

| | | | | |
|---|---|---|---|---|
| 7,701,690 | B1 | 4/2010 | Li et al. | |
| 7,723,969 | B1 | 5/2010 | Li | |
| 2007/0252563 | A1 * | 11/2007 | Kumagai et al. | 323/267 |
| 2007/0259639 | A1 * | 11/2007 | Kovacic et al. | 455/252.1 |

OTHER PUBLICATIONS

Yushan Li et al., "High Efficiency Wide Bandwidth Power Supplies for GSM and Edge RF Power Amplifiers," 2005 IEEE, pp. 1314-1317.
Biranchinath Sahu et al., "A High-Efficiency Linear RF Power Amplifier With a Power-Tracking Dynamically Adaptive Buck-Boost Supply," IEEE Transactions on Microwave Theory and Techniques, vol. 52, No. 1, Jan. 2004, pp. 112-120.
Rajarshi Paul, et al., "Smooth Transition and Ripple Reduction in 4-Switch Non-Inverting Buck-Boost Power Converter for WCDMA RF Power Amplifier", 2008 IEEE, p. 3266-3269.
"LM3668, 1A, High Efficiency Dual Mode Single Inductor Buck Boost DC/DC Converter", National Semiconductor Corporation, Mar. 24, 2009, 18 pages.
Jingquan Chen, et al., "Analysis and Design of a Low-Stress Buck-Boost Converter in Universal-Input PFC Applications", IEEE Transactions on Power Electronics, vol. 21, No. 2, Mar. 2006, p. 320-329.
LM3209 Product Brief, "Seamless-Transition Buck-Boost Converter for LTE and HSUPA", National Semiconductor Corporation, Oct. 21, 2009, 4 pages.
Feipeng Wang, et al., "Wideband Envelope Elimination and Restoration Power Amplifier with High Efficiency Wideband Envelope Amplifier for WLAN 802.11g Applications", 2005 IEEE, p. 645-648.
V. Yousefzadeh, et al., "Efficiency Optimization in Linear-Assisted Switching Power Converters for Envelope Tracking in RF Power Amplifiers", 2005 IEEE, p. 1302-1305.
Frederick H. Raab, et al., "Power Amplifiers and Transmitter for RF and Microwave", IEEE Transactions on Microwave Theory and Techniques, vol. 50, No. 3, Mar. 2002, p. 814-826.
"LMH6678, Low Power 2-Channel Central-Office xDSL Driver", National Semiconductor Corporation, Dec. 2003, 17 pages.
Craig Steinbeiser, et al., "250W HVHBT Doherty with 57% WCDMA Efficiency Linearized to -55dBc for 2c11 6.5dB PAR", 2007 IEEE, 4 pages.
Yu Zhao, et al., "Doherty Amplifier with DSP Control to Improve Performance in CDMA Operation", 2003 IEEE, p. 687-690.
Tae-Woo Kwak, et al., "A 2 W CMOS Hybrid Switching Amplitude Modulator for EDGE Polar Transmitters", IEEE Journal of Solid-State Circuits, vol. 42, No. 12, Dec. 2007, p. 2666-2676.
J. Staudinger, et al., "High Efficiency CDMA RF Power Amplifier Using Dynamic Envelope Tracking Technique", 2000 IEEE, p. 873-876.
Jeremy Popp, et al., "A Fully-Integrated Highly-Efficient RF Class E SiGe Power Amplifier With an Envelope-Tracking Technique for EDGE Applications", 2006 IEEE, p. 231-234.
Jennifer Kithcen, et al., "Combined Linear and Δ-Modulated Switched-Mode PA Supply Modulator for Polar Transmitters", 2007 IEEE International Solid-State Circuits Conference, 3 pages.
Donald F. Kimball, et al., "High-Efficiency Envelope-Tracking W-CDMA Base-Station Amplifier Using GaN HFETs", IEEE Transactions on Microwave Theory and Techniques, vol. 54, No. 11, Nov. 2006, p. 3848-3856.
Yushan Li, "System and Method for Providing Optimized Feedback Loop Compensation for Buck/Boost Switching Power Converters", U.S. Appl. No. 12/157,223, filed Jun. 9, 2008.
Yushan Li, "System and Method for Providing a Dynamically Configured Low Drop Out Regulator With Zero Quiescent Current and Fast Transient Response", U.S. Appl. No. 12/008,852, filed Jan. 15, 2008.
Yushan Li, "Power Amplifier Multiple Stage Control for Polar Modulation Circuit", U.S. Appl. No. 12/152,227, filed May 13, 2008.
Yushan Li, "Circuit for Pulse Width Modulation (PWM) Signal Generation in Buck-Boost Switching Power Converters and Related Method", U.S. Appl. No. 12/577,596, filed Oct. 12, 2009.
Hans P. Tuinhout et al., "Design and Characterization of a High-Precision Resistor Ladder Test Structure", IEEE Transactions on Semiconductor Manufacturing, vol. 16, No. 2, May 2003, pp. 187-193.
M. Z. Lee et al., "Characteristics of Vertical Thermal/PECVD Polysilicon Oxides Formed on the Sidewall of Polysilicon Films", Journal of the Electrochemical Society, 150 (1) pp. G28-G32 (2003).
Shylaja Katakam et al., "Resistor Matching Characterization for Process Development Using D/A Converter", Proc. IEEE 2001 Int. Conference on Microelectronic Test Structures, vol. 14, Mar. 2001, pp. 219-222.
Abu H. M. Kamel et al., Obtaining Silicide Free Spacers by Optimizing Sputter Etch for Deep Submicron CMOS Processes, IEEE Transactions on Semiconductor Manufacturing, vol. 15, No. 3, Aug. 2002, pp. 350-354.
S.Y. Ku et al., "Pre-Metal Clean Optimization for Cluster Defect Prevention", 2001 IEEE, pp. 499-501.
Stefan Hausser et al., "Mismatch in Diffusion Resistors Caused by Photolithography", IEEE Transactions on Semiconductor Manufacturing, vol. 16, No. 2, May 2003, pp. 181-186.
Biranchinath Sahu, et al., "A High Efficiency WCDMA RF Power Amplifier With Adaptive, Dual-Mode Buck-Boost Supply and Bias-Current Control", IEEE Microwave and Wireless Components Letters, vol. 17, No. 3, Mar. 2007, p. 238-240.
Bumman Kim, et al., "High Efficiency RF Transmitter Architectures Modulating Power Supply", 2007 IEEE, Sep. 26-28, 2007, p. 149-155.
Vahid Yousefzadeh, et al., "Digitally Controlled DC-DC Converter for RF Power Amplifier", 2004 IEEE, p. 81-87.
Biranchinath Sahu, et al., "System-Level Requirements of DC-DC Converters for Dynamic Power Supplies of Power Amplifiers", 2002 IEEE, p. 149-152.

* cited by examiner

SYSTEM AND METHOD FOR CONTROLLING A REGULATOR CIRCUIT FOR RADIO FREQUENCY POWER AMPLIFIER BIASES

TECHNICAL FIELD OF THE INVENTION

The system and method of the present invention is generally directed to the manufacture of integrated circuits and, in particular, to a system and method for controlling a regulator circuit for multi-band radio frequency power amplifier biases.

BACKGROUND OF THE INVENTION

Portable communication devices such as cellular phones typically have a number of radio frequency (RF) power amplifiers (PAs) in order to be able to handle transmissions on a number of different communication standards (e.g., Wideband Code Division Multiple Access (WCDMA), Global System for Mobile Communications (GSM/EDGE)) and on different communication bands (e.g., low band (800 MHz to 900 MHz), high band (1.8 GHz to 1.9 GHz). Each power ampflifier (PA) may have its own individual value of bias voltage.

In prior art radio frequency (RF) power management circuits, each individual value of bias voltage may be provided by an individual regulator (e.g., low drop out (LDO) regulator) in order to meet specified load requirements. For communication systems that have many different power amplifiers (PAs), this approach will require many different regulators in order to provide the required bias voltages for the power amplifier (PA) biases.

For example, in the Direct Current (DC) to Direct Current (DC) Converter LM3280 manufactured by National Semiconductor Corporation there are three low dropout (LDO) regulators that provide three bias voltages intended for three Wideband Code Division Multiple Access (WCDMA) power amplifiers. This type of architecture is illustrated in FIG. 1.

As shown in FIG. 1, prior art circuit 100 employs three regulators (110, 120, 130). First regulator 110 receives an enable signal EN1 and a reference voltage signal $V_{REF}$ and outputs an output voltage $V_{BIAS1}$. Second regulator 120 receives an enable signal EN2 and a reference voltage signal $V_{REF}$ and outputs an output voltage $V_{BIAS2}$. Third regulator 130 receives an enable signal EN3 and a reference voltage signal $V_{REF}$ and outputs an output voltage $V_{BIAS3}$. The three regulators (110, 120, 130) operate in parallel. Each regulator may comprise a low dropout (LDO) regulator circuit, a charge pump regulator circuit (also known as a switching capacitor regulator circuit), or any similar type of regulator circuit.

In other types of prior art circuits there are two regulators for the low band power amplifiers (PAs) and two regulators for the high band power amplifiers (PAs). There will be a need for an increased number of regulators as cellular phone technology continues to develop. There will be a need to be able to handle more standards and more frequency bands. For example, there are presently ten (10) frequency bands in Wideband Code Division Multiple Access (WCDMA) technology.

One prior art approach to reducing the number of regulators for the power amplifier (PA) bias voltages is to switch the output of a regulator to one specific bias voltage output port and disable the other bias voltage output ports. This approach is illustrated in the circuit 200 shown in FIG. 2. As shown in FIG. 2, one regulator 210 is employed. Regulator 210 separately receives three enable signals (EN1 and EN2 and EN3) on a first input. Regulator 210 receives a reference voltage signal $V_{REF}$ on a second input. Regulator 210 also receives a feedback signal (FB) on a third input.

In response to receiving one of the enable signals (e.g., EN1), regulator 210 outputs to a demultiplexer circuit 220 a regulator voltage $V_{REG}$ that is associated with the received enable signal. The feedback signal (FB) that is provided to the third input of regulator 210 is from a common internal node ($V_{REG}$) taken at the output of the regulator 210.

Demultiplexer circuit 220 also separately receives the three enable signals (EN1 and EN2 and EN3) on a selector input. When the demultiplexer circuit 220 receives the first enable signal EN1, the demultiplexer circuit 220 outputs the regulator voltage signal $V_{REG}$ that is associated with the first enable signal EN1 on the first bias voltage output port as $V_{BIAS1}$. The other two bias voltage output ports ($V_{BIAS2}$ and $V_{BIAS3}$) are disabled.

When the demultiplexer circuit 220 receives the second enable signal EN2, the demultiplexer circuit 220 outputs the regulator voltage signal $V_{REG}$ that is associated with the second enable signal EN2 on the second bias voltage output port as $V_{BIAS2}$. The other two bias voltage output ports ($V_{BIAS1}$ and $V_{BIAS3}$) are disabled. Similarly, when the demultiplexer circuit 220 receives the third enable signal EN3, the demultiplexer circuit 220 outputs the regulator voltage signal $V_{REG}$ that is associated with the third enable signal EN3 on the bias voltage output port as $V_{BIAS3}$. The other two bias voltage output ports ($V_{BIAS1}$ and $V_{BIAS2}$) are disabled.

This prior art approach has several problems. First, all of the power amplifiers (PAs) have to have similar steady state levels. Second, there will be differences at the bias voltage outputs due to loading differences. Third, each bias voltage output will have process, temperature and supply variations due to switch resistance variations.

Therefore, there is a need in the art for a system and method that is capable of solving the problems that occur in the prior art. In particular, there is a need in the art for a system and method for efficiently controlling a regulator circuit for multi-band radio frequency (RF) power amplifier (PA) biases.

The system and method of the present invention solve the problems that are associated with the prior art by controlling the regulator circuit with a feedback loop that is connected to the plurality of the bias voltages that are output from the regulator circuit. The feedback loop comprises a demultiplexer circuit and a multiplexer circuit that each receive an enable signal and provide a feedback signal to the regulator circuit from the bias voltage that is associated with the received enable signal. The system and method of the invention allow the regulator circuit to be configured as needed to provide different values of radio frequency power amplifier bias voltages.

Before undertaking the Detailed Description of the Invention below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior uses, as well as to future uses, of such defined words and phrases.

BRIEF DESCRIPTION OF THE DRAWINGS

For a more complete understanding of the present invention and its advantages, reference is now made to the following description taken in conjunction with the accompanying drawings, in which like reference numerals represent like parts.

DETAILED DESCRIPTION OF THE INVENTION

FIGS. 3 through 6, discussed below, and the various embodiments used to describe the principles of the present invention in this patent document are by way of illustration only and should not be construed in any way to limit the scope of the invention. Those skilled in the art will understand that the principles of the present invention may be implemented with any type of suitably arranged integrated circuit device.

Figure 3:
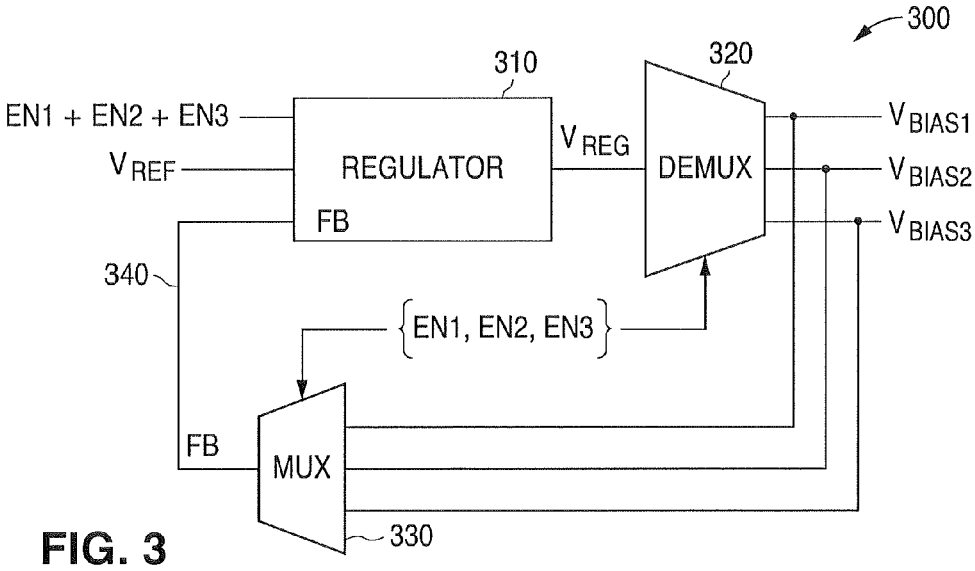
FIG. 3 illustrates a schematic diagram of a regulator circuit constructed in accordance with the principles of the present invention.

The system and method of the present invention provides a feedback loop that provides a feedback signal to the regulator directly from the bias voltage outputs. FIG. 3 illustrates a schematic diagram of an advantageous embodiment 300 of the present invention showing a regulator circuit 310 that separately receives three enable signals (EN1 and EN2 and EN3) on a first input. Regulator 310 receives a reference voltage signal $V_{REF}$ on a second input. Regulator 310 receives a feedback signal (FB) on a third input. The origin of the feedback signal (FB) will be discussed more fully below. In response to receiving one of the enable signals (e.g., EN1), regulator 310 outputs to a demultiplexer circuit 320 a regulator voltage $V_{REG}$ that is associated with the received enable signal.

The three enable signals (EN1 and EN2 and EN3) on the first input of regulator 310 may be decoded from a serial interface (e.g., a two-wire Inter-Integrated Circuit (I2C) bus interface or a three-wire Serial Peripheral Interface (SPI) bus interface). A serial interface may also be used to generate individual $V_{REF}$ signals.

In one advantageous embodiment of the invention regulator circuit 310 comprises a low dropout (LDO) regulator circuit. It is understood that the invention is not limited to a regulator circuit 310 that comprises a low dropout (LDO) regulator circuit. Regulator circuit 310 may comprise any suitable type of regulator circuit including, without limitation, a charge pump regulator circuit (also known as a switching capacitor regulator circuit).

Demultiplexer circuit 320 also separately receives the three enable signals (EN1 and EN2 and EN3) on a selector input. When the demultiplexer circuit 320 receives the first enable signal EN1, the demultiplexer circuit 320 outputs the regulator voltage signal $V_{REG}$ that is associated with the first enable signal EN1 on the first bias voltage output port as $V_{BIAS1}$. The other two bias voltage output ports ($V_{BIAS2}$ and $V_{BIAS3}$) are disabled.

When the demultiplexer circuit 320 receives the second enable signal EN2, the demultiplexer circuit 320 outputs the regulator voltage signal $V_{REG}$ that is associated with the second enable signal EN1 on the second bias voltage output port as $V_{BIAS2}$. The other two bias voltage output ports ($V_{BIAS1}$ and $V_{BIAS3}$) are disabled. Similarly, when the demultiplexer circuit 320 receives the third enable signal EN3, the demultiplexer circuit 320 outputs the regulator voltage signal $V_{REG}$ that is associated with the third enable signal EN3 on the third bias voltage output port as $V_{BIAS3}$. The other two bias voltage output ports ($V_{BIAS1}$ and $V_{BIAS2}$) are disabled.

The prior art regulator 210 receives a feedback signal (FB) from the common internal node $V_{REG}$ that is located between the regulator 210 and the demultiplexer 220. In contrast, the regulator circuit 310 of the present invention receives a feedback signal (FB) directly from the bias voltages that are output from demultiplexer 320.

As shown in FIG. 3, the bias voltage signals on the output ports ($V_{BIAS1}$ and $V_{BIAS2}$ and $V_{BIAS3}$) are provided to three separate inputs of multiplexer 330. Multiplexer circuit 330 separately receives the three enable signals (EN1 and EN2 and EN3) on a selector input. When the multiplexer circuit 330 receives the first enable signal EN1, the multiplexer circuit 330 outputs the first bias voltage signal $V_{BIAS1}$ as a feedback signal (FB) on feedback line 340 to regulator circuit 310. The other two bias voltages ($V_{BIAS2}$ and $V_{BIAS3}$) that are input to multiplexer 330 are disabled.

When the multiplexer circuit 330 receives the second enable signal EN2, the multiplexer circuit 330 outputs the second bias voltage signal $V_{BIAS2}$ as a feedback signal (FB) on feedback line 340 to regulator circuit 310. The other two bias voltages ($V_{BIAS1}$ and $V_{BIAS3}$) that are input to multiplexer 330 are disabled. Similarly, when the multiplexer circuit 330 receives the third enable signal EN3, the multiplexer circuit 330 outputs the third bias voltage signal $V_{BIAS3}$ as a feedback signal (FB) on feedback line 340 to regulator circuit 310. The other two bias voltages ($V_{BIAS1}$ and $V_{BIAS2}$) that are input to multiplexer 330 are disabled.

Figure 1:
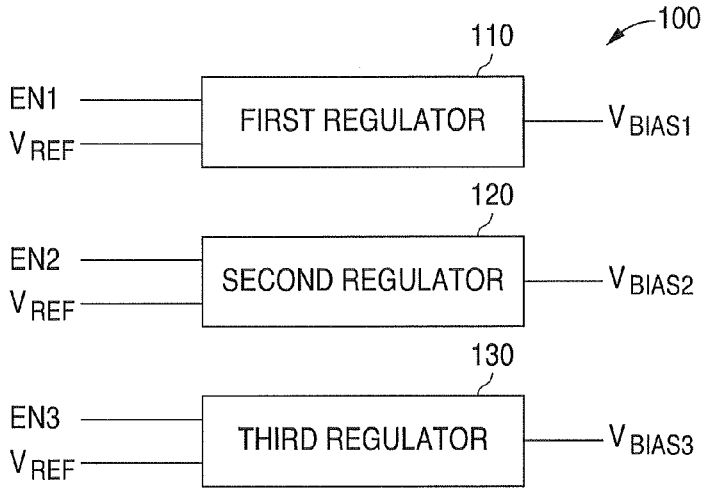
FIG. 1 (PRIOR ART)
FIG. 1 illustrates a schematic diagram of three prior art regulator circuits that each provide a separate bias voltage intended for a power amplifier circuit.
Figure 2:
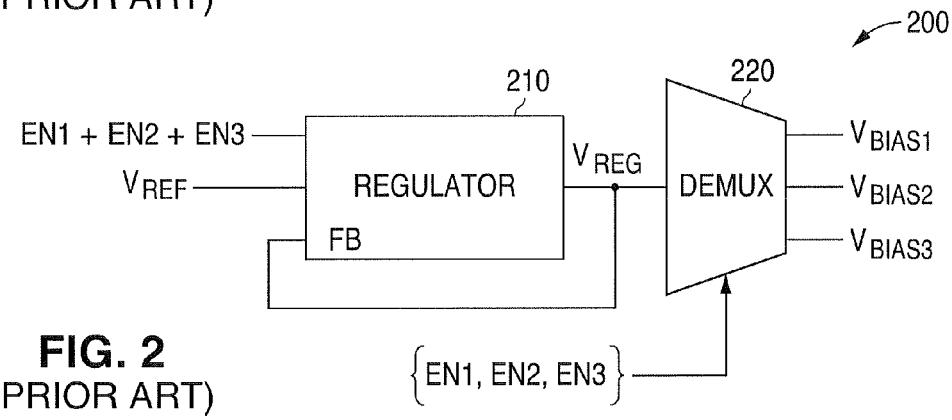
FIG. 2 (PRIOR ART)
FIG. 2 illustrates a schematic diagram of a prior art regulator circuit that provides a regulator voltage to a demultiplexer circuit that transmits the regulator voltage to a selected one of three bias voltage output ports.

The circuitry 300 of the present invention solves the problems associated with the prior art regulator 210 and prior art demultiplexer 220 shown in FIG. 2. The feedback loop of the regulator circuit 310 of the present invention is formed directly from the bias output voltages ($V_{BIAS1}$ and $V_{BIAS2}$ and $V_{BIAS3}$) instead of from a common internal node (such as $V_{REG}$ in FIG. 2).

In an alternate advantageous embodiment of the invention, the regulator 310 may be enabled by a separate signal (not shown) before the arrival of an enable signal (e.g., EN1) for one of the desired values of bias voltage (e.g., $V_{BIAS1}$). The purpose of enabling the regulator 310 in advance is so that the value of $V_{REG}$ will be already stabilized before selecting it for a particular output port. For example, this means that the bias voltage $V_{BIAS1}$ will be available right away when the enable signal EN1 is activated. Otherwise, the bias voltage $V_{BIAS1}$ will be available only after the regulator 310 settles.

Figure 4:
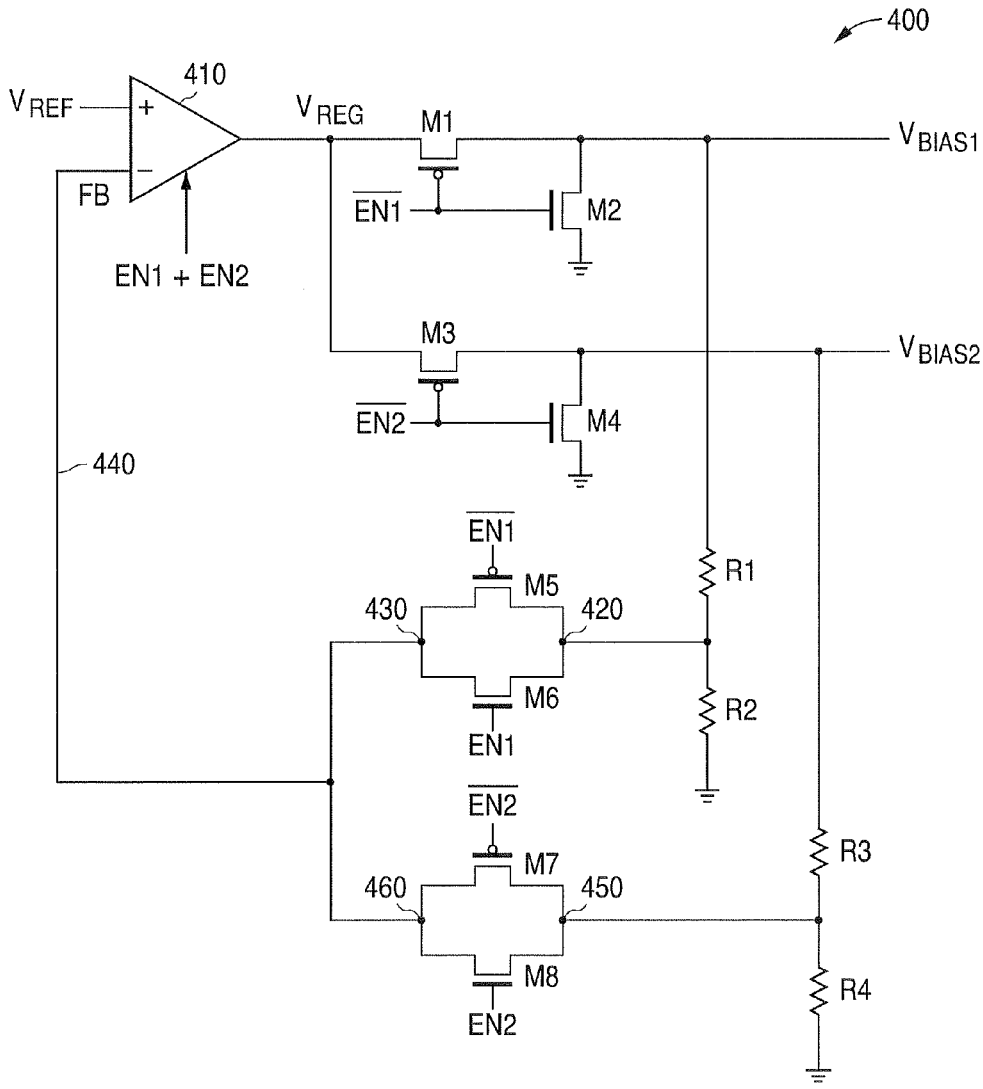
FIG. 4 illustrates a schematic diagram showing a first advantageous embodiment of the present invention for two voltage bias outputs.

FIG. 4 illustrates a schematic diagram showing a first advantageous embodiment 400 of the present invention for two voltage bias outputs ($V_{BIAS1}$ and $V_{BIAS2}$). The regulator circuit 410 may comprise a low dropout (LDO) regulator 410 or a charge pump regulator 410 (or other similar type of regulator). As shown in FIG. 4, the regulator circuit 410 receives as inputs (1) a first enable signal EN1, (2) a second enable signal EN2, (3) a reference voltage signal $V_{REF}$, and (4) a feedback signal (FE). The regulator circuit 410 outputs regulator voltage $V_{REG}$ to a demultiplexer circuit that comprises four transistors (M1, M2, M3, M4) that are connected together as shown in FIG. 4.

The first branch of the demultiplexer comprises P-type metal oxide semiconductor (PMOS) transistor M1 and N-type metal oxide semiconductor (NMOS) transistor M2. A first end of PMOS transistor M1 is connected to the output of the regulator circuit 410 and a second end of PMOS transistor M1 is connected to the first bias voltage output port $V_{BIAS1}$. NMOS transistor M2 has one end connected to a node located between PMOS transistor M1 and the first bias voltage output port $V_{BIAS1}$. NMOS transistor M2 has a second end connected to ground. The gate of the PMOS transistor M1 and the gate of the NMOS transistor M2 are connected to an inverted version $\overline{EN1}$ of the first enable signal EN1. When the first enable signal EN1 is active, the PMOS transistor M1 provides the regulator voltage $V_{REG}$ to the $V_{BIAS1}$ output port.

The second branch of the demultiplexer comprises P-type metal oxide semiconductor (PMOS) transistor M3 and N-type metal oxide semiconductor (NMOS) transistor M4. A first end of the PMOS transistor M3 is connected to the output of the regulator circuit 410 and a second end of the PMOS transistor M3 is connected to the second bias voltage output port $V_{BIAS2}$. NMOS transistor M4 has one end connected to a node located between PMOS transistor M3 and the second bias voltage output port $V_{BIAS2}$. NMOS transistor M4 has a second end connected to ground. The gate of the PMOS transistor M3 and the gate of the NMOS transistor M4 are connected to an inverted version EN2 of the second enable signal EN2. When the second enable signal EN2 is active, the PMOS transistor M3 provides the regulator voltage $V_{REG}$ to the $V_{BIAS2}$ output port.

The first bias voltage $V_{BIAS1}$ and the second bias voltage $V_{BIAS2}$ are also connected to a multiplexer circuit that comprises four transistors (M5, M6, M7, M8) that are connected together as shown in FIG. 4. The first branch of the multiplexer circuit comprises the two transistors M5 and M6 and the second branch of the multiplexer circuit comprises the two transistors M7 and M8.

In the first branch of the multiplexer circuit, P-type metal oxide semiconductor (PMOS) transistor M5 is coupled in parallel with N-type metal oxide semiconductor (NMOS) transistor M6 at input node 420 and at output node 430. The first bias voltage $V_{BIAS1}$ is provided to input node 420 through a first resistor divider that comprises resistors R1 and R2. The gate of the NMOS transistor M6 is connected to the first enable signal EN1 and the gate of the PMOS transistor M5 is connected to an inverted version EN1 of the first enable signal EN1. The output node 430 is connected to the regulator circuit 410 through feedback line 440. When the first enable signal EN1 is active, the output node 430 of the first branch of the multiplexer circuit provides a feedback signal to the regulator circuit 410 on feedback line 440 based on the first bias voltage $V_{BIAS1}$.

In the second branch of the multiplexer circuit, P-type metal oxide semiconductor (PMOS) transistor M7 is coupled in parallel with N-type metal oxide semiconductor (NMOS) transistor M8 at input node 450 and at output node 460. The second bias voltage $V_{BIAS2}$ is provided to input node 450 through a second resistor divider that comprises resistors R3 and R4. The gate of the NMOS transistor M8 is connected to the second enable signal EN2 and the gate of the PMOS transistor M7 is connected to an inverted version $\overline{EN2}$ of the second enable signal EN2. The output node 460 is connected to the regulator circuit 410 through feedback line 440. When the second enable signal EN2 is active, the output node 460 of the second branch of the multiplexer circuit provides a feedback signal to the regulator circuit 410 on feedback line 440 based on the second bias voltage $V_{BIAS2}$.

The first advantageous embodiment 400 of the present invention described above utilized a first resistor divider that comprises resistors R1 and R2 and a second resistor divider that comprises resistors R3 and R4. It is understood that it is also possible to use a direct feedback signal without the use of resistor divider circuits.

Figure 5:
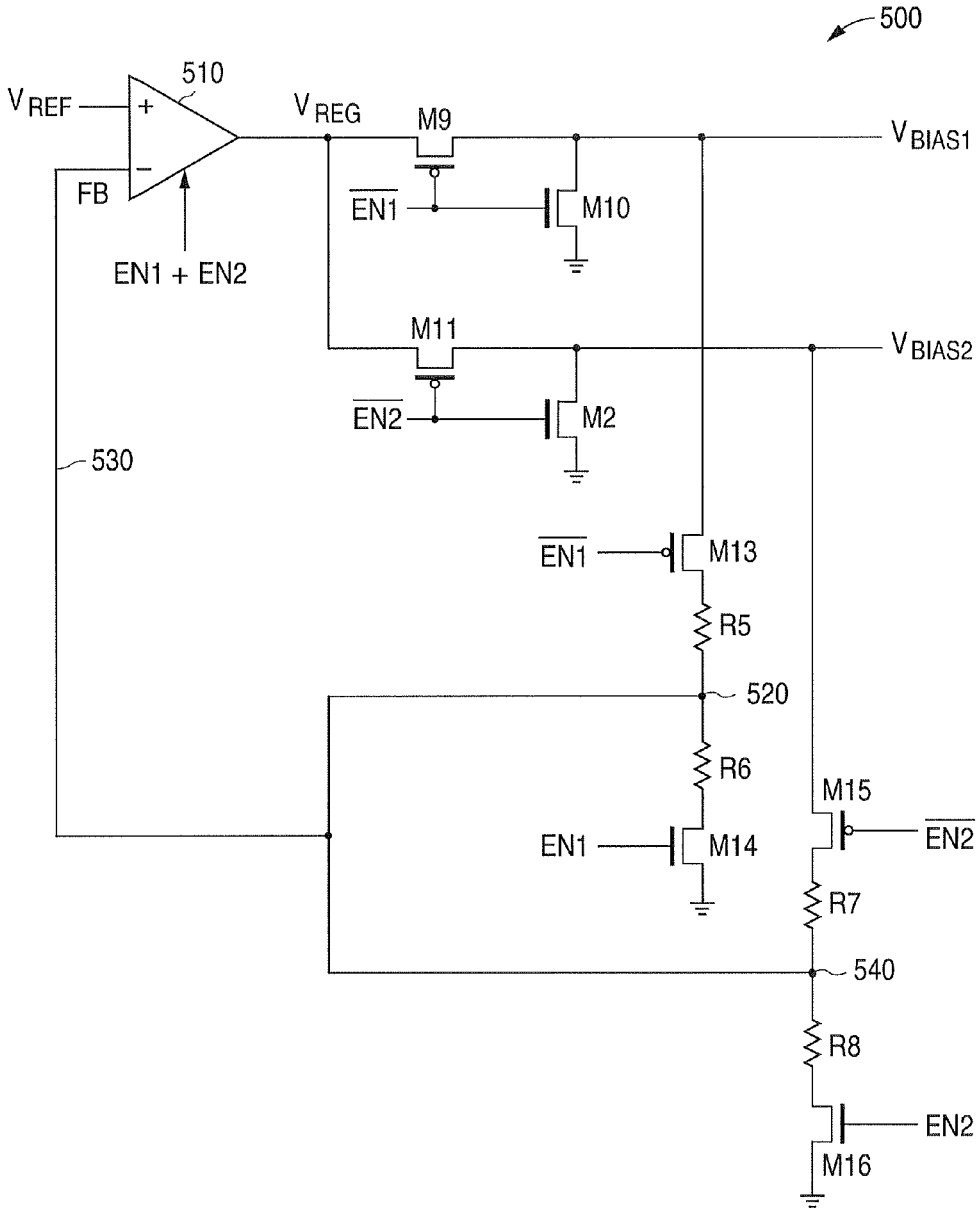
FIG. 5 illustrates a schematic diagram showing a second advantageous embodiment of the present invention for two voltage bias outputs.

FIG. 5 illustrates a schematic diagram showing a second advantageous embodiment 500 of the present invention for two voltage bias outputs ($V_{BIAS1}$ and $V_{BIAS2}$). The regulator circuit 510 may comprise a low dropout (LDO) regulator 510 or a charge pump regulator 510 (or other similar type of regulator). As shown in FIG. 5, the regulator circuit 510 receives as inputs (1) a first enable signal EN1, (2) a second enable signal EN2, (3) a reference voltage signal $V_{REF}$, and (4) a feedback signal (FB). The regulator circuit 510 outputs regulator voltage $V_{REG}$ to a demultiplexer circuit that comprises four transistors (M9, M10, M11, M12) that are connected together as shown in FIG. 5.

The first branch of the demultiplexer comprises P-type metal oxide semiconductor (PMOS) transistor M9 and N-type metal oxide semiconductor (NMOS) transistor M10. A first end of PMOS transistor M9 is connected to the output of the regulator circuit 510 and a second end of PMOS transistor M9 is connected to the first bias voltage output port $V_{BIAS1}$. NMOS transistor M10 has one end connected to a node located between PMOS transistor M9 and the first bias voltage output port $V_{BIAS1}$. NMOS transistor M10 has a second end connected to ground. The gate of the PMOS transistor M9 and the gate of the NMOS transistor M10 are connected to an inverted version $\overline{EN1}$ of the first enable signal EN1. When the first enable signal EN1 is active, the PMOS transistor M9 provides the regulator voltage $V_{REG}$ to the $V_{BIAS1}$ output port.

The second branch of the demultiplexer comprises P-type metal oxide semiconductor (PMOS) transistor M11 and N-type metal oxide semiconductor (NMOS) transistor M12. A first end of the PMOS transistor M11 is connected to the output of the regulator circuit 510 and a second end of the PMOS transistor M11 is connected to the second bias voltage output port $V_{BIAS2}$. NMOS transistor M12 has one end connected to a node located between PMOS transistor M11 and the second bias voltage output port $V_{BIAS2}$. NMOS transistor M12 has a second end connected to ground. The gate of the PMOS transistor M11 and the gate of the NMOS transistor M12 are connected to an inverted version $\overline{EN2}$ of the second enable signal EN2. When the second enable signal EN2 is active, the PMOS transistor M11 provides the regulator voltage $V_{REG}$ to the $V_{BIAS2}$ output port.

The first bias voltage $V_{BIAS1}$ and the second bias voltage $V_{BIAS2}$ are also connected to a multiplexer circuit that comprises four transistors (M13, M14, M15, M16) that are connected together as shown in FIG. 5. The first branch of the multiplexer circuit comprises the two transistors M13 and M14 and the second branch of the multiplexer circuit comprises the two transistors M15 and M16.

In the first branch of the multiplexer circuit, P-type metal oxide semiconductor (PMOS) transistor M13 has a first end that is connected to first bias voltage $V_{BIAS1}$ and a second end that is connected to resistor R5 of a first resistor divider circuit that comprises resistor R5 and resistor R6. As shown in FIG. 5, an output node 520 is located between resistor R5 and resistor R6. Output node 520 is connected to regulator circuit 510 through feedback line 530.

N-type metal oxide semiconductor (NMOS) transistor M14 has a first end that is connected to resistor R6 of the first resistor divider circuit. NMOS transistor M14 has a second end that is connected to ground. The gate of NMOS transistor M14 is connected to the first enable signal EN1. The gate of PMOS transistor M13 is connected to an inverted version EN1 of the first enable signal EN1. When the first enable signal EN1 is active, the output node 520 of the first branch of the multiplexer circuit provides a feedback signal to the regulator circuit 510 on feedback line 530 based on the first bias voltage $V_{BIAS1}$.

In the second branch of the multiplexer circuit, P-type metal oxide semiconductor (PMOS) transistor M15 has a first end that is connected to second bias voltage $V_{BIAS2}$ and a second end that is connected to resistor R7 of a second resistor divider circuit that comprises resistor R7 and resistor R8. As shown in FIG. 5, an output node 540 is located between resistor R7 and resistor R8. Output node 540 is connected to regulator circuit 510 through feedback line 530.

N-type metal oxide semiconductor (NMOS) transistor M16 has a first end that is connected to resistor R8 of the second resistor divider circuit. NMOS transistor M16 has a second end that is connected to ground. The gate of NMOS transistor M16 is connected to the second enable signal EN2. The gate of PMOS transistor M15 is connected to an inverted version EN2 of the second enable signal EN2. When the second enable signal $\overline{EN2}$ is active, the output node 540 of the second branch of the multiplexer circuit provides a feedback signal to the regulator circuit 510 on feedback line 530 based on the second bias voltage $V_{BIAS2}$.

The second advantageous embodiment 500 of the present invention described above utilized a first resistor divider that comprises resistors R5 and R6 and a second resistor divider that comprises resistors R7 and R8. It is understood that it is also possible to use a direct feedback signal without the use of resistor divider circuits. It is understood that it is also possible to have a resistor and its respective series switch (e.g., resistor R5 and series switch M13) in a different order.

The first advantageous embodiment 400 and the second advantageous embodiment 500 of the present invention has been described for the case in which there are two voltage bias outputs ($V_{BIAS1}$ and $V_{BIAS2}$). It is understood that the principles of the present invention can be extended to cases in which there are more than two bias voltages. In addition, it is also understood that there are also many other ways to implement a feedback multiplexer circuit depending upon the feedback potential.

In the advantageous embodiments of the present invention that have been described a fixed reference voltage $V_{REF}$ is shown (presumably an internally generated reference voltage). It is understood that it is also possible that the reference voltage $V_{REF}$ could also be scaled to different values for different values of bias voltage $V_{BIAS}$.

Figure 6:
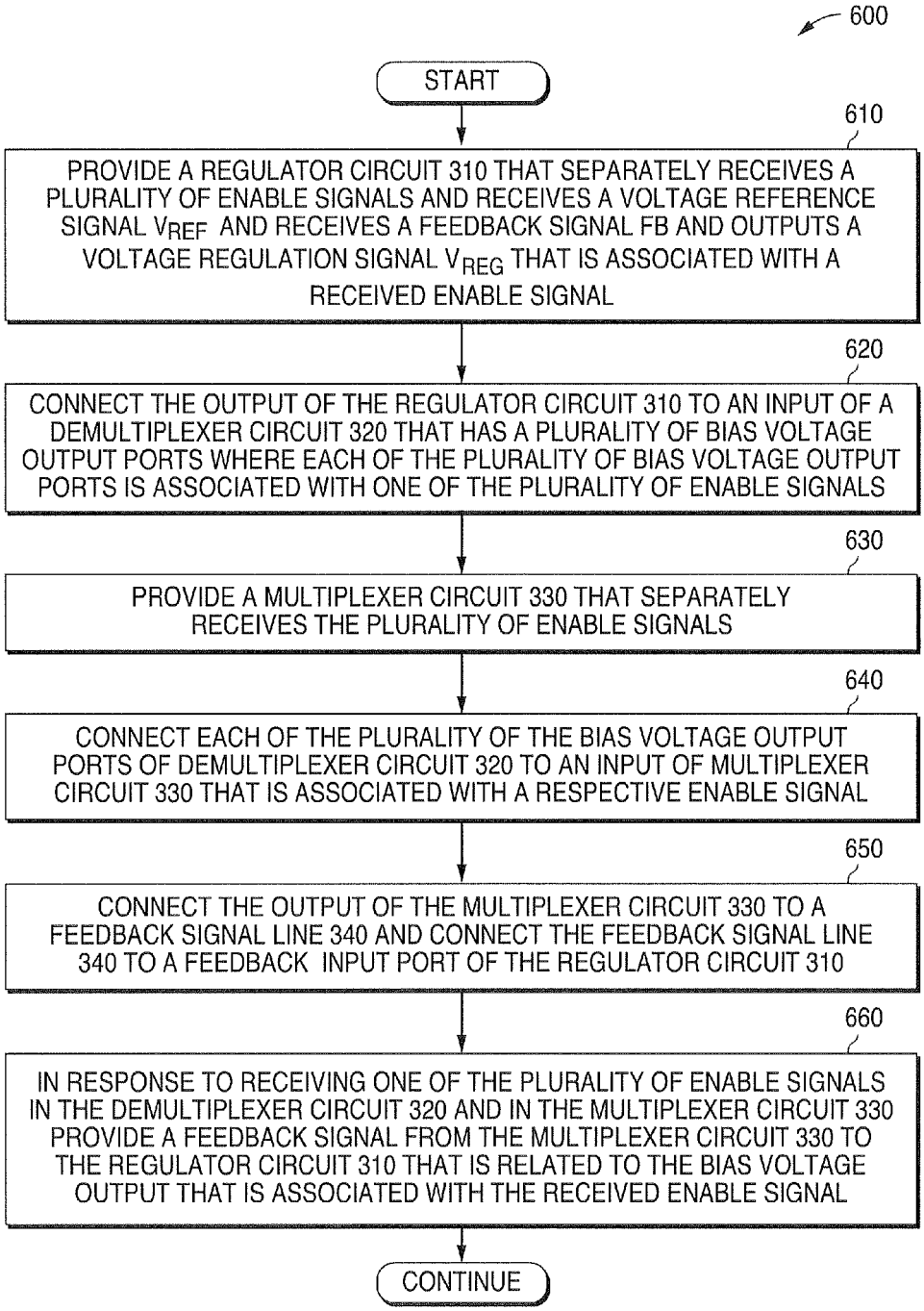
FIG. 6 illustrates a flow chart showing the steps of an advantageous embodiment of a method of the present invention.

FIG. 6 illustrates a flow chart 600 showing the steps of an advantageous embodiment of a method of the present invention. In the first step of the method a regulator circuit 310 is provided that separately receives a plurality of enable signals and receives a voltage reference signal $V_{REF}$ and receives a feedback signal FB and outputs a voltage regulation signal $V_{REG}$ (step 610). Then the output of the regulator circuit 310 is connected to the input of a demultiplexer circuit 320 that has a plurality of bias voltage output ports where each of the plurality of bias voltage output ports is associated with one of the plurality of enable signals (step 620).

Then a multiplexer circuit 330 is provided that separately receives the plurality of enable signals (step 630). Then each of the plurality of bias voltage output ports of the demultiplexer circuit 320 is connected to an input of multiplexer circuit 330 that is associated with a respective enable signal (step 640). Then the output of the multiplexer circuit 330 is connected to a feedback signal line 340 and the feedback signal line 340 is connected to a feedback input port of the regulator circuit 310 (step 650).

In response to receiving one of the plurality of enable signals in the demultiplexer circuit 320 and in the multiplexer circuit 330, the multiplexer circuit 330 provides a feedback signal to the regulator circuit 310 that is related to the bias voltage output that is associated with the received enable signal (step 660).

The foregoing description has outlined in detail the features and technical advantages of the present invention so that persons who are skilled in the art may understand the advantages of the invention. Persons who are skilled in the art should appreciate that they may readily use the conception and the specific embodiment of the invention that is disclosed as a basis for modifying or designing other structures for carrying out the same purposes of the present invention. Persons who are skilled in the art should also realize that such equivalent constructions do not depart from the spirit and scope of the invention in its broadest form.

For example, it is possible to connect to the regulator circuit 310 a plurality of separate feedback lines (not shown) to form a separate feedback loop from each of the plurality of bias output voltage ports. This embodiment would not need the multiplexer 330. This approach, however, would not be efficient for large numbers of bias output voltage ports.

Although the present invention has been described with an exemplary embodiment, various changes and modifications may be suggested to one skilled in the art. It is intended that the present invention encompass such changes and modifications as fall within the scope of the appended claims.

What is claimed is:

1. A method of controlling a regulator circuit that outputs a plurality of bias voltages, the method comprising the steps of:

providing a feedback signal to the regulator circuit using a feedback loop connecting the plurality of bias voltages to the regulator circuit, the feedback signal associated with one of the bias voltages; and providing to the regulator circuit a plurality of enable signals, each enable signal associated with one of the bias voltages, an output of the regulator circuit connected to an input of a demultiplexer circuit that has a plurality of bias voltage output ports, each bias voltage output port associated with one of the enable signals.

2. The method as claimed in claim 1, wherein the regulator circuit comprises one of: a low dropout regulator circuit, a charge pump regulator circuit, and a switching regulator circuit.

3. The method as claimed in claim 1, wherein the plurality of bias voltages comprises a plurality of radio frequency power amplifier bias voltages.

4. A method of controlling a regulator circuit that outputs a plurality of bias voltages, the method comprising the steps of:

providing a feedback signal to the regulator circuit using a feedback loop connecting the plurality of bias voltages to the regulator circuit, the feedback signal associated with one of the bias voltages;

providing to a demultiplexer circuit a plurality of enable signals, an output of the regulator circuit connected to an input of the demultiplexer circuit, the demultiplexer circuit having a plurality of bias voltage output ports, each bias voltage output port associated with one of the enable signals; operating the regulator circuit to stabilize a signal output by the regulator circuit before any of the enable signals are provided to the regulator circuit; and providing to the regulator circuit the plurality of enable signals wherein each enable signal is associated with one of the bias voltages.

5. The method as claimed in claim 1, further comprising the steps of:

receiving at a multiplexer circuit the plurality of enable signals, the plurality of bias voltage output ports of the demultiplexer circuit coupled to a plurality of inputs of the multiplexer circuit.

6. The method as claimed in claim 5, further comprising the step of:

providing an output of the multiplexer circuit to a feedback signal line, the feedback signal line connected to the regulator circuit.

7. The method as claimed in claim 6, further comprising the steps of:

receiving one of the plurality of enable signals at the demultiplexer circuit and at the multiplexer circuit; and in response to the received enable signal, providing the feedback signal to the regulator circuit, the feedback signal related to the bias voltage that is associated with the received enable signal.

8. An apparatus for controlling a regulator circuit that is configured to output a plurality of bias voltages, the apparatus comprising:

a feedback loop connected to the regulator circuit from the plurality of bias voltages that are output from the regulator circuit, the feedback loop comprising circuitry that is configured to provide a feedback signal to the regulator circuit, the feedback signal associated with from one of the bias voltages;

wherein the regulator circuit is configured to receive a plurality of enable signals, each enable signal associated with one of the bias voltages; and wherein the circuitry comprises a demultiplexer circuit having an input connected to an output of the regulator circuit, the demultiplexer circuit having a plurality of bias voltage output ports, each bias voltage output port associated with one of the enable signals.

9. The apparatus as claimed in claim 8, wherein the regulator circuit comprises one of: a low dropout regulator circuit, a charge pump regulator circuit, and a switching regulator circuit.

10. The apparatus as claimed in claim 8, wherein the plurality of bias voltages comprises a plurality of radio frequency power amplifier bias voltages.

11. The apparatus as claimed in claim 9, further comprising:

a multiplexer circuit that is configured to separately receive the plurality of enable signals on a selector input, wherein the multiplexer circuit has a plurality of inputs that are connected to the plurality of bias voltage output ports of the demultiplexer circuit.

12. The apparatus as claimed in claim 11, further comprising a feedback signal line having a first end that is connected to an output of the multiplexer circuit and having a second end that is connected to the regulator circuit.

13. The apparatus as claimed in claim 12, wherein:

the demultiplexer circuit and the multiplexer circuit are configured to receive one of the plurality of enable signals; and in response to the received enable signal, the demultiplexer circuit and the multiplexer circuit are configured to provide the feedback signal to the regulator circuit, the feedback signal related to the bias voltage associated with the received enable signal.

14. A method of controlling a regulator circuit that outputs a plurality of radio frequency power amplifier bias voltages, the method comprising the steps of:

providing a feedback signal to the regulator circuit using a feedback loop connecting the plurality of radio frequency power amplifier bias voltages to the regulator circuit, the feedback signal associated with from one of the radio frequency power amplifier bias voltages; and providing to a demultiplexer circuit a plurality of enable signals, an output of the regulator circuit connected to an input of the demultiplexer circuit, the demultiplexer circuit having a plurality of bias voltage output ports, each bias voltage output port associated with one of the enable signals.

15. The method as claimed in claim 14, wherein the regulator circuit comprises one of: a low dropout regulator circuit, a charge pump regulator circuit, and a switching regulator circuit.

16. The method as claimed in claim 14, further comprising the step of:

providing to the regulator circuit the plurality of enable signals, wherein each enable signal is associated with one of the plurality of radio frequency power amplifier bias voltages.

17. The method as claimed in claim 14, further comprising the step of:

receiving at a multiplexer circuit one of the plurality of enable signals.

18. The method as claimed in claim 17, further comprising the step of:

providing an output of the multiplexer circuit to a feedback signal line, the feedback signal line connected to the regulator circuit.

19. The method as claimed in claim 18, further comprising the steps of:

receiving one of the plurality of enable signals at the demultiplexer circuit and at the multiplexer circuit; and in response to the received enable signal, providing the feedback signal to the regulator circuit, the feedback signal related to the radio frequency power amplifier bias voltage that is associated with the received enable signal.

20. An apparatus comprising:

a voltage regulator configured to generate a plurality of bias voltages;

a demultiplexer having (i) an input coupled to an output of the voltage regulator and (ii) a plurality of demultiplexer outputs, the demultiplexer configured to provide a different one of the bias voltages over a different one of the demultiplexer outputs; and a multiplexer having (i) inputs coupled to the demultiplexer outputs and (ii) an output coupled to a feedback input of the voltage regulator, the multiplexer configured to provide one of the bias voltages as a feedback signal to the voltage regulator;

wherein each of the demultiplexer and the multiplexer is configured to receive a plurality of enable signals on a selector input.

21. The apparatus of claim 20, wherein the voltage regulator is configured to receive the plurality of enable signals, each enable signal associated with one of the bias voltages.

* * * * *